US005711289A

United States Patent [19]

Gabryszewski

[11] Patent Number: 5,711,289

[45] Date of Patent: Jan. 27, 1998

[54] VAPOR REMOVAL SYSTEM FOR BULK ADHESIVE HANDLING SYSTEMS

[75] Inventor: Gregory J. Gabryszewski, Lithonia, Ga.

[73] Assignee: Nordson Corporation, Westlake, Ohio

[21] Appl. No.: 373,045

[22] Filed: Jan. 17, 1995

[51] Int. Cl.[6] ..... F27B 14/00; F27B 14/12

[52] U.S. Cl. ..... 126/284; 126/343.5 A; 126/299 D; 454/49; 432/13; 432/156

[58] Field of Search ..... 126/284, 299 R, 126/299 D, 343, 5 A; 266/158, 159; 454/49; 432/13, 11, 156, 157, 158, 262

[56] References Cited

U.S. PATENT DOCUMENTS

| | | | |
|---|---|---|---|
| 509,257 | 11/1893 | Sommer | 432/156 |
| 769,052 | 8/1904 | Brayshaw | 432/158 |
| 1,451,538 | 4/1923 | Engel | 454/49 |
| 1,896,951 | 2/1933 | Hahn | 454/49 |
| 2,190,068 | 2/1940 | Henschler . | |
| 2,247,891 | 7/1941 | Schneible . | |
| 2,247,892 | 7/1941 | Schneible . | |
| 2,606,016 | 8/1952 | Lindh et al. | 454/49 |
| 2,942,540 | 6/1960 | Lundy . | |
| 3,564,990 | 2/1971 | Smedes . | |
| 3,638,673 | 2/1972 | Stanciu | 137/205 |
| 3,756,582 | 9/1973 | Overmyer et al. . | |
| 3,822,872 | 7/1974 | Nell | 454/49 |
| 3,930,641 | 1/1976 | Overmyer et al. | 454/49 |
| 4,023,943 | 5/1977 | Kipple et al. . | |
| 4,456,151 | 6/1984 | Lewellen . | |
| 4,538,542 | 9/1985 | Kennon et al. . | |
| 4,796,601 | 1/1989 | Yamada | 454/49 |
| 5,238,468 | 8/1993 | Gabryszewski et al. . | |
| 5,338,248 | 8/1994 | Sumrack . | |
| 5,518,221 | 5/1996 | Zurecki et al. | 266/158 |

FOREIGN PATENT DOCUMENTS

| | | | |
|---|---|---|---|
| 0715142A1 | 5/1996 | European Pat. Off. | F27D 23/00 |
| 463041 | 4/1951 | Germany | 432/262 |
| 1148368 | 5/1963 | Germany . | |
| 4307867A1 | 1/1994 | Germany | C22B 9/04 |
| 318044 | 12/1917 | Italy | 432/158 |
| 01203034 | 8/1989 | Japan . | |
| 854147 | 11/1960 | United Kingdom . | |
| 2077419 | 12/1981 | United Kingdom | 454/49 |

*Primary Examiner*—Carl D. Price

*Attorney, Agent, or Firm*—Wood, Herron & Evans, L.L.P.

[57] ABSTRACT

A bulk adhesive handling system (10) having a hopper (16) and a lid (26) includes a vapor removal system (12) comprising a plurality of vent holes (40) formed in the side wall (42) of the hopper (16) of the system. The vent holes (40) are in communication with a venting plenum (44) surrounding the hopper (16), which is connected to a vacuum source (46). The vapor removal system (12) is adapted to withdraw gas from the hopper (16) when the lid (26) is in an open position and to withdraw air from an ambient source when the lid (26) is in a closed position.

28 Claims, 2 Drawing Sheets

VAPOR REMOVAL SYSTEM FOR BULK ADHESIVE HANDLING SYSTEMS

FIELD OF THE INVENTION

The present invention relates generally to vapor removal systems and more particularly to vapor removal systems for bulk adhesive handling systems to prevent irritating, and/or noxious fumes from being vented into the environment of the operator.

BACKGROUND OF THE INVENTION

Hot melt adhesives, or adhesives that are solid at room temperature and which must be melted prior to use, are used in an increasing number of applications. For example, hot melt adhesives may be used for coating substrates, for sealing of packages, for building construction, shoe manufacturing, bookbinding, for the assembly of automobile parts, electronics, electrical equipment, appliances, electrical components, furniture, and for metal-to-metal bonds, to name but a few. The common forms of hot melt adhesives include pressure sensitive adhesives (PSA), ethyl vinyl acetate (EVA), polyurethane reactive adhesives (PUR), and animal based adhesives. Because the hot melt adhesives are solid at room temperature, it is necessary to melt the adhesive prior to application.

In the process of melting and maintaining the hot melt adhesive in a molten state, the hot melt adhesive may generate vapors, which may escape out of the melting unit and into the environment of the operator. For example, when bulk adhesive handling units are used that comprise a lidded hopper for receiving the hot melt adhesive and a melting grid therebeneath to melt the adhesive, vapors from the molten hot melt adhesive may escape through the top of the hopper when the lid is open. Additionally, when the lid to the hopper is in a closed position, a build-up of pressure in the hopper due to the heating of the hot melt adhesive may result in vapors escaping through leak points in the hot melt adhesive system. As the vapors may be irritating and/or foul smelling, it is often desirable to vent these vapors from the environment of the operator. Moreover, some of the manufacturers of hot melt adhesives require ventilation during use.

For example, polyurethane reactive adhesives or PUR is an adhesive that cures in the presence of ambient moisture. Typically, methylene bisphenyl diisocyanate (MDI) is used as a curative in these adhesives and the vapors from the hot melt will contain particles of this curative. OSHA dictates that the MDI levels in the operator's environment not exceed 5 parts per billion. To achieve this goal, many adhesive manufacturers recommend that adequate ventilation be provided. Thus, bulk adhesive handling systems may require a vapor removal system to reduce exposure of the operator to the vapors from the molten hot melt adhesive.

Existing vapor removal systems typically place an air vent plenum next to the source of the vapors, such as the open hopper or vat containing the molten hot melt adhesive. The vapor removal system draws free air along with the vapors across the vat or hopper and into the venting plenum. Thus, the airstreams developed by the vent system must capture the vapors from the molten adhesive. However, as the distance from the furthest capture point to the inlet of the vent duct is relatively large in this type of configuration (i.e., extends across the entire hopper or vat), the venting system generally must have a relatively high volume flow rate of air to achieve adequate capture velocity at the farthest point. This may require a venting system having a volume flow rate in excess of 1,000 standard cubic feet per minute. Such a high volume flow rate increases the cost of conditioning the make-up air in the facility as well as the cost of purchasing and operating the required blower system.

Moreover, with the relatively large distances involved between the air vent plenum and the outermost point along the hopper, any perturbations across the top of the hopper will cause vapors to escape the vent system and be released into the operator's atmosphere. Still further, because the vapor removal system is typically external of the bulk adhesive handling system, it may not be capable of capturing vapors escaping through leak points in the bulk adhesive handling system when the lid to the hopper is closed.

The need to capture vapors is particularly acute in bulk adhesive handling systems wherein the hot melt adhesive is placed into the hopper in containers, such as 55 gallon drums. During the changeover of containers, a highly concentrated collection of heated vapors is present in the hopper. As a container is lowered into the hopper, the vapors within the hopper may be forced outwardly through the open top of the hopper. It has been found that venting systems which draw air across the top of the hopper to capture the vapors are not effective in capturing the vapors. Specifically, the insertion of the container into the hopper disrupts the vent flow path, thereby preventing the venting system from capturing the vapors that are being forced outwardly from the hopper.

Therefore, there is a need for a vapor removal system for hot melt adhesive melting units, such as bulk adhesive handling systems, that is adapted to capture vapors generated by hot melt adhesives therein, but which is not affected by perturbations in the airstream outside of the hopper. Further, there is a need for a vapor removal system having a lower volume flow rate than existing systems to reduce the cost and complexity of the vapor removal system. Still further, there is a need for a vapor removal system that is able to capture vapors when the lid to the bulk adhesive handling system is closed.

SUMMARY OF THE INVENTION

The present invention provides a vapor removal system which overcomes drawbacks associated with current systems. More specifically, the vapor removal system of the present invention captures vapors emanating from an apparatus, such as a bulk adhesive handling system, while utilizing a venting system having a volume flow rate of not more than about 300 standard cubic feet per minute. To this end, the vapor removal system of the present invention comprises an apparatus for melting material that includes a hopper to receive the material to be melted, such as hot melt adhesive, and wherein the hopper has an open top and a side wall. Disposed within the apparatus is a melting unit for melting the material to be melted. Formed within the side wall of the hopper is a plurality of vent holes that are adapted to withdraw the vapors from the hopper. The vent holes are operatively interconnected to a vacuum source such that a substantially uniform volume of gas is withdrawn through each of the vent holes.

The vent holes are connected to the vacuum source through a venting plenum, which surrounds the hopper in the region near the vent holes. The hopper preferably has a cylindrical shape with the vacuum source being connected to the venting plenum at a plurality of locations spaced equally about the circumference of the hopper. Preferably, the vacuum source is connected to the venting plenum at two locations on opposing sides of the hopper.

The vapor removal system may also include a deflector projecting inwardly over the open upper end of the hopper, the deflector being adapted to deflect downwardly gas moving upwardly along the side wall of the hopper. Preferably the deflector extends inwardly about one-fourth inch to about one-half inch over the upper end of the hopper. Further, as the vent holes are located within the hopper, a low pressure area is generated below the deflector such that ambient air is drawn through the open upper end and into the hopper.

The plurality of vent holes are spaced substantially equally along a circumference of the cylindrical wall, and preferably there are six equally spaced vent holes. Moreover, for a system adapted to receive a standard 55 gallon container, the vent holes are positioned about six inches below the top of the hopper.

The apparatus may further include a lid over the hopper, wherein the lid is selectively movable between an open position and a closed position. Additionally, the vacuum source is adapted to withdraw gas through the venting plenum, and hence the vent holes in the hopper, when the lid is in the open position, and to draw air from an ambient source when the lid is in a closed position. Further, the air from the ambient source may be drawn across equipment that requires cooling, such as the pump and manifold assembly of a bulk adhesive handling system.

To this end, the vapor removal system may include a venting network having an exhaust path interconnected at a common junction to a vent path in communication with the venting plenum and an ambient source path in communication with an ambient source of air. Located within the common junction is a flow diverter valve that is selectively positionable between a first position and a second position. The flow diverter valve is operatively interconnected to the lid such that, when the lid is in the open position, the flow diverter valve is also in a first position wherein the exhaust path is in communication with the vent path and the vacuum source withdraws vapors from the hopper. Alternatively, when the lid is in a closed position, the flow diverter valve is in a second position, wherein the exhaust path is in communication with the ambient source path and the vacuum source draws ambient air.

Moreover, when the lid is closed, any build-up of pressure within the hopper due to the heating of the material to be melted is withdrawn by the vapor removal system through venting means, such as a bleed hole, formed in the flow diverter valve.

In use, when the apparatus lid is open, gas, including vapors generated by the material to be molten, is withdrawn from the hopper and through the plurality of vent holes formed in the side wall such that the generated vapors in the hopper are withdrawn. Moreover, by withdrawing gas through the vent holes, a low pressure area is generated below the deflector, which causes ambient air to be drawn through the open upper end and into the hopper. Further, the deflector deflects downwardly gas that is moving upwardly along the side wall of the hopper.

The gas that is withdrawn through the vent holes is withdrawn into the venting plenum which surrounds the hopper and, in turn, vacuumed from the venting plenum into the vacuum source for exhausting the gas externally of the bulk adhesive handling system. Additionally, the vapor removal system is preferably interconnected to the lid on the hopper such that, when the lid is in an open position, the vacuum source vacuums gas from the venting plenum, and when the lid is in a closed position, the vacuum source vacuums air from an ambient source. To this end, upon opening the lid, the flow diverter valve located within the exhaust path is placed in the first position such that gas is vacuumed from the venting plenum and through the vent path. Alternatively, upon closing the lid, the flow diverter valve is placed in the second position such that air is vacuumed through the ambient source path.

By virtue of the foregoing, there is thus provided a vapor removal system that is capable of capturing the vapors generated by material, such as hot melt adhesive, in the hopper of an apparatus for melting that material, such as a bulk adhesive handling system. Further, the vapor removal system is adapted to perform this function while requiring a volume flow rate substantially less than that associated with existing systems. Still further, the vapor removal system is adapted to vent the hopper when the lid is closed such that vapors do not leak out of the apparatus and into the environment of the operator.

These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

DETAILED DESCRIPTION OF THE INVENTION

Figure 1:
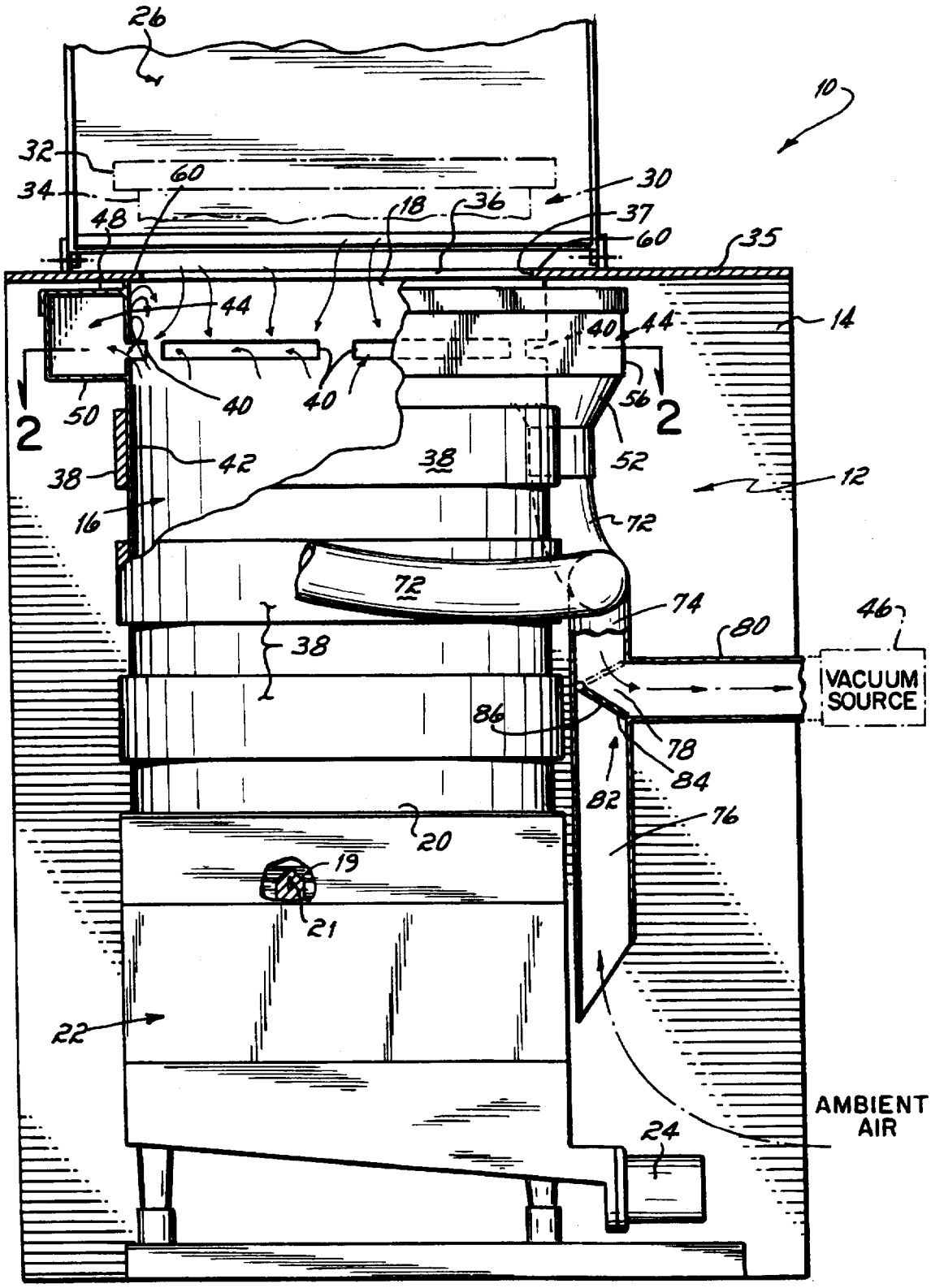
FIG. 1 is a front elevational view, partially broken away, of a bulk adhesive handling system including a vapor removal system in accordance with the principles of the present invention.
Figure 2:
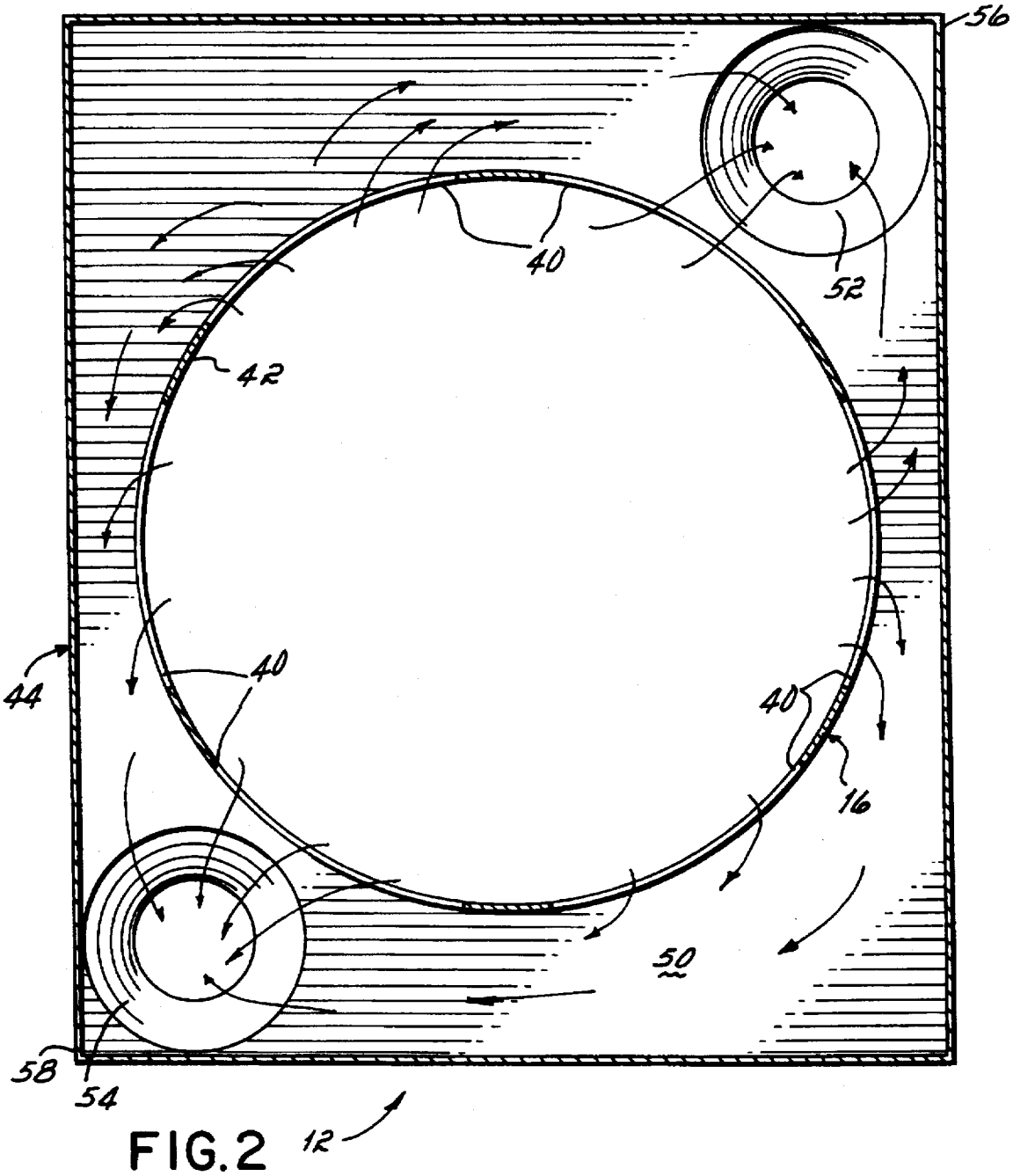
FIG. 2 is a section view taken along line 2—2 of FIG. 1.
Figure 3:
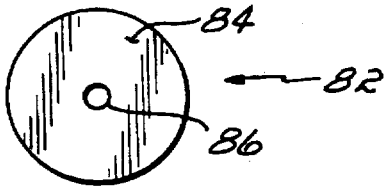
FIG. 3 is a front view of the plate of the flow diverter valve.

FIGS. 1–3 illustrate a bulk adhesive handling system 10 having a vapor removal system 12 for capturing the vapors emanating from molten material, such as molten hot melt adhesive, held within bulk adhesive handling unit 10. To this end, and in accordance with the principles of the present invention, bulk adhesive handling system 10 comprises a housing 14, a hopper 16 supported therein having an open upper end 18 and a lower end 20, a melting unit or grid 19 with a heating element 21 therein disposed beneath lower end 20 of hopper 16, and a reservoir 22 positioned beneath melting grid 19, the reservoir being in fluid communication with a pump and manifold assembly 24. Vapor removal system 12 is positioned within housing 14 and surrounds hopper 16 in a manner to be described below.

Hopper 16, which is preferably cylindrical but which may be any shape, is adapted to receive solid hot melt adhesive, either as granules, pellets, or other small units, or in bulk form, such as in a container 30, as shown. Container 30 has an open lower end (not shown) to permit the release of the hot melt adhesive contained therein. Preferably, hopper 16 is sized to receive a 55 gallon container of adhesive, as is common. However, as will be readily appreciated, hopper 16 may be sized to accommodate containers of different sizes, such as 1 gallon or 5 gallon containers, or various quantities of granules or pellets of hot melt adhesive. Moreover, housing 14 includes a top 35 having an aperture 36 formed therein that is sized to receive container 30 therethrough.

The inner periphery 37 of aperture 36 extends over open upper end 18 of hopper 16 for a purpose to be described below.

Container 30 may be suspended within hopper 16 by any number of well known means. For example, a clamp ring 32 may be placed around the upper end 34 of container 30 for supporting container 30 on housing 14. Alternatively, container 30 could be supported by the melting grid, or by any inwardly projecting structure within hopper 16, such as a ledge or ring. These and other variations will be readily apparent to those skilled in the art.

As the hot melt adhesive is solid when placed within bulk adhesive handling system 10, the hot melt adhesive must be molten prior to use. Where the hot melt adhesive is a one-piece solid within container 30, the adhesive must first be withdrawn therefrom. To this end, band heaters 38 surround hopper 16, which, when activated, serve to heat the hot melt adhesive within container 30 such that the hot melt flows out of, or is released as a solid unit from, container 30. As will be readily appreciated by those skilled in the art, other types of heaters may be used to remove the adhesive from container 30, such as, by way of example, cylindrical heaters or cartridge heaters.

The hot melt adhesive that is released from container 30, or hot melt adhesive placed in hopper 16 in granule or pellet form, is then passed through melting grid 19. The melting grid is effective to partially melt the body of hot melt adhesive and pass it downwardly into reservoir 22. Reservoir 22, which also includes heater units (not shown), serves to fully melt the hot melt adhesive for delivery by the pump and manifold assembly 24 to an applicator system (not shown). To dose off hopper 16 from the environment during use, a lid 26 is attached to housing 14 such that the lid is selectively positionable between a first open position and second closed position.

The hot melt adhesive, which is molten for use, produces vapors which rise within hopper 16 and which may escape into the operator's environment when lid 26 is in the open position. To prevent these vapors from entering the environment of the operator, vapor removal system 12 captures the vapors before they can pass through the open lid 26 of bulk adhesive handling system 10. To this end, vapor removal system 12 includes a plurality of vent holes 40 formed in the side wall 42 of hopper 16. Vent holes 40 are operatively interconnected to a vacuum source 46 by a venting plenum 44, which surrounds hopper 16 in the area adjacent vent holes 40. Vacuum source 46 and venting plenum 44 cooperate to withdraw a substantially uniform volume of gas through each of vent holes 40. Moreover, it has been found to be advantageous for hopper 16 and side wall 42 to be cylindrical as vapor removal system 12 operates more effectively in this configuration.

Vent holes 40 are spaced substantially equally along a circumference of cylindrical side wall 42. When hopper 16 is sized to receive a standard 55 gallon container, vent holes 40 are preferably positioned about six inches below upper end 18 of hopper 16. Preferably, there are six vent holes spaced equally along a circumference of hopper 16, with each vent hole spanning an angular distance of about 45°, with about a 15° spacing therebetween. Moreover, vent holes 40 have a height of about one-fourth inch to about one-half inch. However, as will be readily appreciated by those skilled in the art, vent holes 40 may have any number of configurations, spacings, and sizes, without departing from the spirit or scope of the present invention. The dimensions of the exemplary embodiment are included merely to describe one configuration found to provide the desired benefits.

Vent holes 40 open into venting plenum 44, which is a substantially rectangular duct surrounding hopper 16 in the region adjacent vent holes 40. In particular, the top wall 48 of venting plenum 44 is positioned just beneath open upper end 18 and the lower wall 50 of venting plenum 44 is located just beneath vent holes 40. Further, although venting plenum 44 is described as a rectangular box-like structure, it will be readily appreciated that other structures may be used, such as a cylindrical or otherwise shaped plenum, so long as venting plenum 44 is communication with all of vent holes 40.

To render vent holes 40 effective in withdrawing vapors from hopper 16, venting plenum 44 is interconnected to vacuum source 46. As best seen in FIG. 2, vacuum source 46 is connected to venting plenum 44 at a plurality of locations spaced substantially equally about cylindrical side wall 42. Although any number of connections may be used, it has been found that connecting vacuum source 46 to venting plenum 44 at two vacuum connections 52, 54 in opposing corners 56, 58, respectively, of venting plenum 44 provides the desired effect.

The plurality of exit points for the gas from venting plenum 44 ensures that a more uniform volume of gas is withdrawn through each of vent holes 40 than would otherwise occur if only one exit path for the vacuumed gas was located in venting plenum 44. As shown by the arrows in FIG. 2, gas withdrawn through vent holes 40 is directed toward the opposing vacuum connections 52, 54.

This uniform drawing of gas out of each of vent holes 40 in turn results in a more efficient vapor removal system. First, by uniformly drawing gas out of each of vent holes 40, the entire hopper 16 will be vacuumed. Thus, no "dead spots" will be present in hopper 16 such that vapors may escape from hopper 16 along one side of cylindrical side wall 42. Next, as the air velocity needed to capture vapors is proportional to the square of the distance from the vacuum source, uniformly drawing gas through all of vent holes 40 reduces the power needed for vacuum source 46. Specifically, in the present invention, the maximum capture distance is equal to the radius of hopper 16. By contrast, in existing venting systems which draw air across the hopper, the maximum capture distance is the diameter of the hopper. As such, with the vapor removal system 12 of the present invention, vacuum source 46 requires power which is about one-fourth that necessary for existing systems. Accordingly, whereas existing systems sized to receive a 55 gallon container and which draw air across the hopper require a vacuum source having a capacity in excess of 1,000 standard cubic feet per minute, vapor removal system 12 of the present invention is capable of capturing substantially all of the vapors generated by the hot melt adhesive with a vacuum source 46 having a capacity of no greater than 300 standard cubic feet per minute. This provides a substantial savings in the energy required to operate the system, reduces the amount of make-up air necessary to be conditioned within the operator's environment, and reduces the cost and complexity of vacuum source 46.

Although the vapor removal system 12 described thus far is effective in removing the vapors generated by the hot melt adhesive within hopper 16, it has been found beneficial for the inner periphery 37 of aperture 36 formed in the top 35 of housing 14 to extend inwardly over open upper end 18 of hopper 16 about one-fourth inch to about one-half inch to form a deflector 60, which is preferably annular in shape. This provides a two-fold advantage.

First, housing 14 is generally constructed of material having a thickness and a strength in excess of that used for hopper 16. Thus, housing 14 is able to suspend container 30 within hopper 16. Further, this permits the components within housing 14 to be substantially isolated from the housing. Thus, impacts and other external forces do not effect the operation of bulk adhesive handling system 10.

Second, the deflector 60 serves to redirect or deflect downwardly vapors moving upwardly along cylindrical side wall 42. In particular, and as demonstrated by the arrows in FIG. 1, as vapors are drawn upwardly from within hopper 16, some vapors may overshoot vent holes 40. Deflector 60 interrupts the boundary layer of gas moving upwardly along cylindrical wall 42 and redirects it back downwardly into hopper 16. Further, as vapor removal system 12 is drawing gas out of hopper 16, deflector 60 also serves to generate a low pressure area between vent holes 40 and deflector 60, which draws ambient air downwardly through open end 18 and into hopper 16. Hence, the entering ambient air further deflects vapors downwardly and toward vent holes 40. Thus, deflector 60 serves to prevent the escape of vapors which are able to by-pass vent holes 40.

Moreover, the low pressure area generated within hopper 16 also enables vapor removal system 12 to capture substantially all of the vapors within hopper 16 even when a container 30 is being lowered into hopper 16. Specifically, the placement of container 30 into hopper 16 displaces a large volume of vapor-laden gas from hopper 16. Vapor removal system 12 is effective in capturing the displaced gas, while the low pressure area below deflector 60 prevents gas from escaping out of hopper 16. Thus, even though container 30 is displacing a large volume of gas within hopper 16, vapor removal system 12 prevents vapors from being ejected into the environment of the operator.

The vapor removal system 12 of the present invention is thus adapted to capture the vapors generated by hot melt adhesive within hopper 16 with a substantially lower powered vacuum source than that of existing systems. However, there is one final consideration. Although it is desirable for vacuum source 46 to draw gas through vent holes 40 and venting plenum 44 when lid 26 is in an open position, when lid 26 is in a closed position, there is no need to withdraw this volume of gas from hopper 16. In fact, attempting to draw a large volume of gas out of hopper 16 when lid 26 is closed results in hopper 16 being subjected to a large negative pressure. This, in turn, may cause leakage of ambient air into the system, which is undesirable in some applications.

Accordingly, vacuum source 46 of the present invention is adapted to withdraw air from an ambient source when lid 26 is in a closed position. To this end, vacuum connections 52, 54 are connected by tubing 72 to a common vent path 74. In turn, vent path 74 joins with an ambient source path 76 at a common junction 78. Common junction 78 then connects to an exhaust path 80 which exits out of bulk adhesive handling system 10. Thus, exhaust path 80 may withdraw vapors from hopper 16 through vent path 74, or may draw ambient air from ambient source path 76.

To permit exhaust path 80 to withdraw vapors from vent path 74 when lid 26 is in an open position, and to draw ambient air from ambient source path 76 when lid 26 is in a closed position, common junction includes a flow diverter valve 82 therein. Flow diverter valve 82 is operatively interconnected to lid 26 by means not shown such that, when lid 26 is in an open position, the valve plate 84 of flow diverter valve 82 is in the position shown in solid line in FIG. 1. In this position, exhaust path 80 is in communication with vent path 74 such that vacuum source 46 withdraws vapors from hopper 16 through vent holes 40 and venting plenum 44. Alternatively, when lid 26 is in a closed position, valve plate 84 of flow diverter valve 82 is placed in the second position shown in phantom line in FIG. 1, wherein exhaust path 80 is in communication with ambient source path 76. Thus, vapor removal system 12 is effective in withdrawing vapors from hopper 16 when lid 26 is in an open position, and to draw air through ambient source path 76 when lid 26 is in a closed position.

As ambient air is drawn through ambient source path 76 when lid 26 is in a closed position, ambient source path 76 may be constructed to draw air across equipment requiring cooling during operation of bulk adhesive handling system 10. For example, ambient source path 76 may be adapted to draw air across pump and manifold assembly 24. Thus, vapor removal system 12 in accordance with the principles of the present invention may serve a dual function, thereby eliminating the need for separate cooling equipment for pump and manifold assembly 24.

Although when lid 26 is in a closed position, vapors are generally unable to pass out of hopper 16 and into the environment of the operator, as hopper 16 is heated in use, the vapors generated by the melting of the hot melt adhesive and the heating of the air in hopper 16 may cause a build-up of pressure within hopper 16. This build-up of pressure may force the vapors within hopper 16 out of leakage points that may exist in the system and into the environment of the operator. To vent the pressure from within hopper 16 when lid 26 is in a closed position, and thereby eliminate the leakage of vapors into the environment of the operator, valve plate 84 of flow diverter valve 82 is preferably manufactured with means for venting and reducing the internal pressure in the hopper, such as by a bleed hole 86 formed therein (FIG. 3). Thus, when valve plate 84 is in the second position shown by phantom line in FIG. 1, any positive pressure within hopper 16 is bled outwardly through bleed hole 86 and into exhaust path 80 for elimination outside the environment of the operator.

Moreover, although flow diverter valve 82 is shown as a single valve being toggled between two positions, as will be readily apparent to those skilled in the art, the single flow diverter valve of the present invention could be replaced by two damper valves acting opposite and in tandem to selectively place exhaust path 80 into communication with vent path 74 and ambient source path 76.

In use, bulk adhesive handling system 10 is activated to melt hot melt adhesive contained within hopper 16 and reservoir 22. Generally, when bulk adhesive handling system 10 is first activated, lid 26 will be in a closed position. Thus, flow diverter valve 82 will be in the second position and vacuum source 46 will be drawing air from ambient source path 76. When hot melt adhesive is to be added to hopper 16, lid 26 is put into an open position. At this point, valve plate 84 of flow diverter valve 82 is placed in the first position (shown in solid line in FIG. 1), wherein exhaust path 80 is placed into communication with vent path 74. Vacuum source 46 is then effective to withdraw gas through vent holes 40, into venting plenum 44, through vacuum connections 52, 54, and into vent path 74 for exhaust through exhaust path 80. After inserting new material into hopper 16, such as a new container, lid 26 is then placed into a closed position. At this point, valve plate 84 of flow diverter valve 82 is placed into the second position (shown in phantom line in FIG. 1) wherein exhaust path 80 is placed into communication with ambient source path 76. As bulk adhesive handling system 10 continues heating the hot melt adhesive within hopper 16 and reservoir 22 when lid 26 is closed, the hot melt adhesive gives off vapors. Bleed hole 86 in valve plate 84 permits the vapors in hopper 16 to be exhausted from hopper 16 through vent holes 40, venting plenum 44, and vent path 74, and into exhaust path 80.

By virtue of the foregoing, there is thus provided a vapor removal system 12 that is capable of capturing vapors generated by the hot melt adhesive in the hopper 16 of a bulk adhesive handling system 10, while requiring a volume flow rate substantially less than that associated with existing systems. Further, vapor removal system 12 is adapted to vent hopper 16 when lid 26 is in a closed position, such that vapors do not leak out of bulk adhesive handling system 10 and into the environment of the operator.

While the present invention has been illustrated by description of one embodiment that has been described in considerable detail, it is not the intention of the applicant to restrict or in any way limit the scope of the appended claims to such detail. Additional advantages will readily appear to those skilled in the art. For example, vacuum source 46 may be connected directly to vent holes 40, without the need for the intervening venting plenum 44. Further, although the exemplary embodiment is described with respect to hot melt adhesives, it will be readily apparent that the principles of the present invention apply to any device that is used to melt a material, such as, by way of example, sealants and caulks. Thus, the invention in its broadest aspects is not limited to the specific details, representative apparatus and method, and illustrative examples shown and described. Accordingly, departures may be made from the details without departing from the spirit or scope of applicant's general inventive concept.

What is claimed is:

1. A vapor removal system comprising:

an apparatus including a hopper sized to receive material to be melted, said hopper having an open upper end, a side wall, and a deflector projecting inwardly over said open upper end of said hopper and along the entire perimeter thereof, said deflector adapted to deflect downwardly gas moving upwardly along said side wall of said hopper;

a melting unit for melting the material within said hopper;

a plurality of vent holes formed in said side wall of said hopper, said vent holes being adapted to withdraw gas from said hopper; and a vacuum source operatively interconnected to said plurality of vent holes such that gas is withdrawn through each of said vent holes.

2. The vapor removal system of claim 1 wherein said vacuum source is operatively interconnected to said plurality of vent holes by a venting plenum surrounding said hopper in the area near said vent holes, said venting plenum being in fluid communication with said plurality of vent holes.

3. The vapor removal system of claim 2 wherein said vacuum source is connected to said venting plenum at a plurality of locations spaced substantially equally about said hopper.

4. The vapor removal system of claim 3 wherein said vacuum source is connected to said venting plenum at two locations, said two locations being on opposing sides of said hopper.

5. The vapor removal system of claim 2 wherein said vacuum source draws out gas at the rate of about 300 standard cubic feet per minute.

6. The vapor removal system of claim 2 further comprising a lid over said hopper, said lid being selectively movable between an open position and a closed position, said vacuum source adapted to withdraw gas through said venting plenum when said lid is in said open position and to draw air from an independent ambient source when said lid is in said closed position.

7. The vapor removal system of claim 6 further comprising an ambient source path operatively interconnecting said vacuum source and said ambient source, said ambient source path positioned to draw air from said ambient source across a portion of said apparatus to cool said portion of said apparatus.

8. The vapor removal system of claim 7 wherein said portion of said apparatus to be cooled is a pump and manifold assembly.

9. The vapor removal system of claim 1, said vapor removal system generating a low pressure area below said deflector such that ambient air is drawn through said open upper end of said hopper and into said hopper.

10. The vapor removal system of claim 1 wherein said hopper and said side wall are cylindrical, said plurality of said vent holes being spaced substantially equally along a circumference of said cylindrical side wall.

11. The vapor removal system of claim 10 wherein there are 6 of said vent holes.

12. The vapor removal system of claim 1 wherein said vent holes are positioned about 6 inches below said upper end of said hopper.

13. A vapor removal system for bulk adhesive handling systems comprising:

a hot melt adhesive apparatus including a cylindrical hopper sized to receive a container of hot melt adhesive, said hopper having an open upper end and a cylindrical wall;

a plurality of vent holes formed in said cylindrical wall of said hopper, said vent holes spaced substantially equally about a circumference of said cylindrical wall of said hopper and being adapted to withdraw gas from said hopper;

a venting plenum surrounding said cylindrical hopper, said venting plenum being in fluid communication with said plurality of vent holes;

a vacuum source connected to said venting plenum at two locations on opposing sides of said hopper, said vacuum source adapted to withdraw vapors generated by hot melt adhesive in said hopper through said vent holes; and an annular deflector projecting inwardly over said open upper end of said hopper, said deflector adapted to deflect downwardly gas moving upwardly along said cylindrical wall of said hopper when said vapor removal system is in use.

14. A method of removing vapors from an apparatus for melting materials including a hopper sized to receive the material to be melted, said hopper having an open upper end, a side wall, and a deflector projecting inwardly over said open upper end of said hopper, comprising:

inserting into said hopper the material to be melted;

melting said material to be melted;

generating a low pressure area below said deflector to draw ambient air through said open under end of said hopper:

deflecting downwardly with said deflector gas moving upwardly alone said wall of said hopper; and withdrawing gas from said hopper through a plurality of vent holes formed in said side wall such that vapors generated by said material to be melted in said hopper are withdrawn through said vent holes.

15. The method of removing vapors of claim 14 wherein withdrawing gas through said vent holes includes withdrawing gas at a rate of about 300 standard cubic feet per minute.

16. The method of removing vapors of claim 14 further comprising:

withdrawing said gas through said vent holes and into a venting plenum surrounding said hopper; and vacuuming said gas from said venting plenum into a vacuum source for exhausting said gas externally to said apparatus for melting material, said vacuum source operatively interconnected to said venting plenum at a plurality of locations spaced equally about said hopper such that a substantially uniform volume of gas is withdrawn through each of said vent holes.

17. The method of removing vapors of claim 16, said apparatus for melting material further including a lid over said hopper operatively interconnected to said vacuum source, said lid being selectively movable between an open and a closed position, further comprising:

vacuuming said gas from said venting plenum when said lid is in an open position; and vacuuming air from an ambient source when said lid is in a closed position.

18. The method of removing vapors of claim 16, said apparatus for melting materials further including a lid over said hopper operatively interconnected to said vacuum source, said lid being selectively movable between an open and a closed position, said vacuum source including a venting network having an exhaust path interconnected at a common junction to a vent path in communication with said venting plenum and an ambient source path in communication with an ambient source of air, and a flow diverter valve located in said common junction being operatively interconnected to said lid, said flow diverter valve being selectively positionable between a first position when said lid is in said open position, wherein said exhaust path is in communication with said vent path, and a second position when said lid is in said closed position, wherein said exhaust path is in communication with said ambient source path, further comprising:

opening said lid;

placing said flow diverter valve in said first position;

vacuuming said gas from said venting plenum through said vent path;

closing said lid;

placing said flow diverter valve in said second position; and vacuuming air through said ambient source path.

19. A vapor removal system comprising:

an apparatus including a hopper sized to receive material to be melted, said hopper having an open upper end, a side wall, and a lid over said hopper, said lid being selectively movable between an open position and a closed position;

a melting unit for melting the material within said hopper;

a plurality of vent holes formed in said side wall of said hopper, said vent holes being adapted to withdraw gas from said hopper;

a vacuum source operatively interconnected to said plurality of vent holes by a venting plenum surrounding said hopper in the area near said vent holes, said venting plenum being in fluid communication with said plurality of vent holes;

an exhaust path interconnected at a common junction to a vent path in communication with said venting plenum and an ambient source path in communication with an ambient source of air; and a flow diverter valve located in said common junction and being operatively interconnected to said lid, said flow diverter valve being selectively positionable between a first position when said lid is in said open position, wherein said exhaust path is in communication with said vent path such that said vacuum source withdraws gas through said venting plenum, and a second position when said lid is in said closed position, wherein said exhaust path is in communication with said ambient source path such that said vacuum draws air from an ambient source.

20. The vapor removal system of claim 19 further comprising means for reducing the internal pressure within said hopper when said valve is in said second position.

21. The vapor removal system of claim 20 wherein said means for reducing the internal pressure within said hopper includes a bleed hole formed in said flow diverter valve.

22. A method of removing vapors from an apparatus for melting materials including a hopper sized to receive the material to be melted, said hopper having an open upper end and a side wall, a lid over said hopper, said lid being selectively movable between an open and a closed position, and a vacuum source including a venting network having an exhaust path interconnected at a common junction to a vent path in communication with said venting plenum and an ambient source path in communication with an ambient source of air, and a flow diverter valve located in said common junction being operatively interconnected to said lid, said flow diverter valve being selectively positionable between a first position when said lid is in said open position, wherein said exhaust path is in communication with said vent path, and a second position when said lid is in said closed position, wherein said exhaust path is in communication with said ambient source path, comprising:

opening said lid;

placing said flow diverter valve in said first position;

vacuuming gas from said hopper through a plurality of vent holes formed in said side wall such that vapors generated by said material to be melted in said hopper are withdrawn through said vent holes and into said venting plenum surrounding said hopper;

vacuuming said gas from said venting plenum into a vacuum source for exhausting said gas externally to said apparatus for melting material;

inserting into said hopper the material to be melted;

closing said lid;

placing said flow diverter valve in said second position;

vacuuming air through said ambient source path; and melting said material to be melted.

23. A vapor removal system comprising:

an apparatus including a hopper sized to receive material to be melted, said hopper having an open upper end, a side wall, and a deflector projecting inwardly over said open upper end of said hopper, said deflector adapted to deflect downwardly gas moving upwardly along said side wall of said hopper;

a melting unit for melting the material within said hopper;

a plurality of vent holes formed in said side wall of said hopper, said vent holes being adapted to withdraw gas from said hopper;

a venting plenum surrounding said hopper in the area near said vent holes, said venting plenum being in fluid communication with said plurality of vent holes; and a vacuum source connected to said venting plenum at a plurality of locations to vacuum a gas through each of said vent holes.

24. The vapor removal system of claim 23 wherein said hopper and said side wall are cylindrical, said plurality of said vent holes being spaced substantially equally along a circumference of said cylindrical side wall and each of said vent holes being of substantially the same size.

25. The vapor removal system of claim 23 wherein said vacuum source is connected to said venting plenum at a plurality of locations spaced substantially equally about said hopper.

26. A vapor removal system comprising:

an apparatus including a hopper sized to receive material to be melted, said hopper having an open upper end and a side wall;

a melting unit for melting the material within said hopper;

a plurality of vent holes formed in said side wall of said hopper, said vent holes being adapted to withdraw gas from said hopper;

a venting plenum surrounding said hopper in the area near said vent holes, said venting plenum being in fluid communication with said plurality of vent holes;

a vacuum source connected to said venting plenum at a plurality of locations to vacuum a gas through each of said vent holes; and a lid over said hopper, said lid being selectively movable between an open position and a closed position, said vacuum source adapted to withdraw gas through said venting plenum when said lid is in said open position and to draw air from an independent ambient source when said lid is in said closed position.

27. The vapor removal system of claim 26 further comprising a venting network including:

an exhaust path interconnected at a common junction to a vent path in communication with said venting plenum and an ambient source path in communication with an ambient source of air; and a flow diverter valve located in said common junction and being operatively interconnected to said lid, said flow diverter valve being selectively positionable between a first position when said lid is in said open position, wherein said exhaust path is in communication with said vent path such that said vacuum source withdraws gas through said venting plenum, and a second position when said lid is in said closed position, wherein said exhaust path is in communication with said ambient source path such that said vacuum draws air from an ambient source.

28. The vapor removal system of claim 27 further comprising a bleed hole formed in said flow diverter valve for reducing the internal pressure within said hopper when said valve is in said second position.

* * * * *